US007712410B2

(12) United States Patent
Starrett et al.

(10) Patent No.: US 7,712,410 B2
(45) Date of Patent: May 11, 2010

(54) METHOD OF AND SYSTEM FOR SEDIMENTATION RETAINING BARRIER PACKING AND HANDLING

(75) Inventors: Kenneth Starrett, Arlington, TX (US); Rocky A. Van Gilder, Rice Lake, WI (US)

(73) Assignee: American Excelsior Company, Arlington, TX (US)

( * ) Notice: Subject to any disclaimer, the term of this patent is extended or adjusted under 35 U.S.C. 154(b) by 0 days.

(21) Appl. No.: 12/165,719

(22) Filed: Jul. 1, 2008

(65) Prior Publication Data

US 2009/0010718 A1 Jan. 8, 2009

Related U.S. Application Data

(62) Division of application No. 11/252,647, filed on Oct. 18, 2005, now Pat. No. 7,415,923.

(60) Provisional application No. 60/619,662, filed on Oct. 18, 2004.

(51) Int. Cl.
*B65B 13/20* (2006.01)

(52) U.S. Cl. ..... 100/3; 53/399; 53/429; 53/436

(58) Field of Classification Search ..... 100/1, 100/3, 7, 8; 53/429, 436, 399
See application file for complete search history.

(56) References Cited

U.S. PATENT DOCUMENTS 2,820,282 A * 1/1958 Schneider, Jr. ..... 100/1
4,474,846 A 10/1984 Doerer et al.
4,610,568 A 9/1986 Koerner
5,007,766 A 4/1991 Freed et al.
5,160,215 A 11/1992 Jensen
5,330,828 A 7/1994 Jacobsen, Jr. et al.
5,419,659 A 5/1995 Mercer
5,459,181 A 10/1995 West et al.
5,484,501 A 1/1996 Jacobsen, Jr. et al.
5,575,199 A * 11/1996 Yamamoto ..... 100/34
5,584,600 A 12/1996 Langdon
5,595,458 A 1/1997 Grabhorn
5,605,416 A 2/1997 Roach
5,651,641 A 7/1997 Stephens et al.
5,709,925 A 1/1998 Spengler et al.
5,852,969 A 12/1998 Anthony
5,942,029 A 8/1999 Spittle
6,056,901 A 5/2000 Hamatani et al.
6,109,835 A 8/2000 Grabhorn
6,694,869 B2 * 2/2004 Sutton et al. ..... 100/34
6,709,202 B2 3/2004 Spangler et al.
6,855,650 B1 2/2005 Bohannon, Jr.
6,910,835 B2 6/2005 Spangler et al.
7,415,923 B2 * 8/2008 Starrett et al. ..... 100/3
2004/0141816 A1 * 7/2004 Spangler et al. ..... 405/302.6

* cited by examiner

*Primary Examiner*—Jimmy T Nguyen
(74) *Attorney, Agent, or Firm*—Winstead PC

(57) ABSTRACT

An erosion control log and method for packing and handling erosion control logs. In one aspect, the erosion control logs are formed, stacked, compressed and prepared for delivery while retaining maximum decompressibility.

13 Claims, 6 Drawing Sheets

METHOD OF AND SYSTEM FOR SEDIMENTATION RETAINING BARRIER PACKING AND HANDLING

RELATED APPLICATION(S)

This application is a divisional of and claims priority from U.S. patent application Ser. No. 11/252,647 now U.S. Pat. No. 7,415,923, titled Method of and System for Sedimentation Retaining Barrier Packing and Handling, filed on Oct. 18, 2005. U.S. patent application Ser. No. 11/252,647 claims priority from and incorporates by reference the entirety of U.S. Provisional Patent Application No. 60/619,662, filed on Oct. 18, 2004.

BACKGROUND OF THE INVENTION

1. Technical Field of the Invention

The present invention relates generally to erosion control logs and, more specifically to the packing and handling thereof and, more particularly, but not by way of limitation, to a system and method for selectively stacking, configuring, compressing, securing and subsequently handling a plurality of erosion control logs adapted for delivery to field site, for the reduction of soil erosion.

2. History of Related Art

For many years, erosion control blankets and logs have achieved widespread commercial acceptance. Their use is worldwide. Erosion control blankets in general are discussed in co-pending U.S. patent application Ser. No. 09/648,906, assigned to the assignee of the present invention. As referenced therein, the blankets resemble a form of fibrous matting in which outer layers of netting or other material are commonly used to form an envelope or covering about a fibrous interior filler layer of the type commonly used to reduce soil erosion and runoff from erosion-prone areas such as highway embankments or water drainage ditches. They may be manufactured from a variety of materials.

Another erosion control device is the "erosion control log." Erosion control logs utilize fibers packaged within an elongate bag-type of structure for reducing hydraulic energy and filtering sediment-laden runoff. One such erosion control log is sold under the trademark Curlex® sediment log sold by the assignee of the present invention. The sediment log is manufactured from excelsior, also known as wood wool. The log is thus very porous, allowing water to pass through the wood wool, or excelsior matrix, progressively slowing velocity and filtering sediment as it passes through the log diameter. Sediment logs of this type are extremely flexible and contour to the terrain to maintain intimate contact with the subgrade. Additionally, they come with other benefits such as being lightweight, requiring no trenching, substantially eliminating disposal hassles, and being reusable while holding their shape. Such sediment logs are commonly used in place of straw and hay bale checks, which have been shown to be less than capable of prolonged use in heavy rains wherein the hay bale structurally degrades resulting in the hay fibers being washed downstream, possibly to clog various water flow outlets. This situation can exacerbate flooding issues. Similarly, silt fences, also commonly used, are prone to being knocked down when rain or strong winds are present, or can be run over by vehicles. The time required to pick up loose hay fibers from hay bales and/or to remove worn out, or dysfunctional silt fences, which must be taken typically to landfills, imposes increased expense to contractors trying to meet the ever-growing number of federal, state and municipal regulations. These regulations are increasingly requiring erosion control around construction sites. Additionally, new regulations are placing limitations on dumping waste material in landfills and restricting the burning of waste materials.

Examples of other prior art structures include those shown in U.S. Pat. Nos. 5,595,458 and 6,109,835, both assigned to Grabhorn, Inc. These patents describe water permeable erosion control bags having flexible mesh walls and wood fiber fragments contained therein. U.S. Pat. No. 5,419,659 to Mercer describes a mesh structure having openings and can be used as a sack or a bag. The structure of U.S. Pat. No. 5,419,659 may be formed into a tubular biaxially stretched mesh structure closed at the top and bottom ends.

Other teachings are present in the above-referenced and following patents, and comments made herein are in no way intended to imply any limitations in the teachings thereof but only to specifically address certain aspects for purposes of describing the related art. The entirety of each of the references cited herein should be reviewed for a full understanding of the related art relative to the present invention.

Additional references to erosion control structures include that shown in U.S. Pat. No. 5,160,215 to Jensen which generally describes a ground surface erosion control device. U.S. Pat. Nos. 5,007,766, 5,584,600, 5,605,416 and 4,610,568 also describe erosion control barriers of various types and shapes. Some of the above-referenced patents describe sediment barriers for reducing the erosive energy of water flow-through on a water course such as a channel for increasing the deposition of sediments therein. The sediment barrier typically includes a plurality of individual strands interwoven and preferably crimped or otherwise distorted in an external configuration so as to provide, in certain instances, fiber-to-fiber cohesion which helps maintain the overall rate of the barrier. As referenced in U.S. Pat. No. 5,007,766, the sediment barrier of this particular design may be anchored in place on a surface or within a gully, so as to maintain the strands in upright relation to the water course.

Typical applications for such erosion control devices, particularly the sediment log sold by the assignee of the present invention, are for energy dissipation and sediment control in ditch bottoms, swales, and in waterways. The sediment log may also be used over bare soils and/or temporary and turf reinforcement blankets. A 360° protection around catch basins and drop inlet structures is also specifically referenced for the Curlex® sediment log as are uses in curb and drainage outlets. Finally, the Curlex® sediment log may be used on project ingress and egress termination points or used in place of bales, silt fences, reinforced silt fences and rock checks, or as wattles on steep slopes. Further information on the Curlex® sediment log may be found at www.curlex.com.

The innovative approach to utilizing excelsior wood fibers in a sediment log comprising an elongated tubular member has been found to be both economically viable and environmentally effective for erosion control considerations. Due to the governmental regulations requiring protective measures in the area of erosion control as referenced above, the shipment and ease of delivery of such erosion control units has become important. Due to the size and length of the sediment control logs, such as the above-referenced Curlex® sediment log, shipping and handling is of major concern for both the manufacturer and the ultimate user. When the logs are improperly packaged they can become distorted and the efficiency in use for sediment control reduced. When the logs are shipped in an elongated stack configuration, the amount of space necessary for shipment has been shown to be less than cost effective. It would be an advantage therefore to provide a system for efficient, space-saving packing and handling sediment logs in a manner facilitating reduced distortion and ease in handling and use.

SUMMARY OF THE INVENTION

The present invention relates to the packing and handling of sediment logs of elongate sediment control members. More particularly, one aspect of the invention comprises the system of folding and stacking elongate sediment logs in an open compression hopper with each of the logs curled into a generally U shape, J shape, or other pre-selected shape/configuration known to minimize the distortion and/or damage to the log while allowing the configured logs to be stacked one atop the other in a nesting relationship. In this manner, a minimal amount of space is therein required for containing the uncompressed logs. The assemblage is then prepared in the hopper for compression and, once compressed, the assemblage is wrapped with straps, tethers or other members adapted to bind the compressed logs. In this manner, a plurality of elongate sediment control logs are assembled and packaged for shipment in a configuration imparting minimal permanent deformation, for maximum efficiency in use and in a substantially reduced space for maximizing shipping and handling effectiveness.

One aspect of the present invention utilizes a commercial baling hopper for compressing and wrapping the sediment logs prior to shipment. Another aspect of the present invention relates to sediment logs formed of excelsior or wood wool construction disposed in an elongate net structure creating a tubular member of compressible wood wool therein.

In another aspect, the present invention relates to a method of packing and handling elongate sediment control members of the type forming an elongate body of randomly dispersed, loose-fill fibers having a select loft for retaining sedimentation fluid passing therethrough when disposed for erosion control, the loose fill fibers being packaged in open mesh material. The method comprises the steps of assembling the sediment control members for packing, providing a compression hopper adapted for receipt of the assembled sediment control members therein, situating individual sediment control members within the hopper and shaping them into a serpentine assembly for subsequent compression, actuating compression of the hopper and compressing the shaped assembly of sediment control members, binding the compressed sediment control members, removing the bound sediment control members from the hopper, permitting the bound sediment control members to be delivered in the bound condition to a site for decompression and erosion control, and removing the binding from the compressed sediment control members at the sites for erosion control for the positioning and decompression thereof and placement for erosion control.

In another aspect, the above-described method includes the steps of providing the loose fill fibers in the form of wood wool and providing the wood wool in the form of excelsior loose fill that is bent, crimped and twisted. The method further includes the step of providing the mesh material in the form of a generally cylindrical net sleeve, which sleeve is formed from synthetic fibers such as polyethylene, polypropylene, and other polyolefins.

In a further aspect, the above described method includes the step of shaping individual sediment control members by bending the sediment control members into a U or J shape within the hopper. A further step includes compressing the shaped elongate sediment control members in the hopper on the order of 60% of the original diameter thereof.

Yet a further aspect of the invention includes a system of packing elongate sediment control members of the type forming an elongate body of randomly dispersed, loose fill fibers having a select loft for retaining sedimentation in fluid passing therethrough when disposed for erosion control, the loose fill fibers being packaged in open mesh material. The system comprises a compression hopper adapted for receipt of the sediment control members therein and the compression thereof and means for situating individual sediment control members within the hopper and shaping them into a serpentine assembly for subsequent compression within the hopper. Also provided are means for binding the compressed sediment control members within the hopper for subsequent handling in the compressed state. The loose fill fibers may comprise wood wool in the form of excelsior loose fill that is bent, crimped and twisted. The compression hopper may be adapted to compress the sediment control members to approximately 60% of the original diameter thereof.

BRIEF DESCRIPTION OF THE DRAWINGS

The preferred embodiment of the invention will now be described, by way of example only, with reference to the accompanying drawings in which.

DETAILED DESCRIPTION OF ILLUSTRATIVE EMBODIMENTS OF THE INVENTION

The present invention will now be described more fully hereinafter with reference to the accompanying drawings in which several preferred embodiments of the invention are shown. This invention may, however, be embodied in many different forms and should not be construed as being limited to the embodiments set forth herein. Rather, the embodiments are provided so that this disclosure is thorough and complete, and fully conveys the scope of the invention to those skilled in the art.

Figure 1:
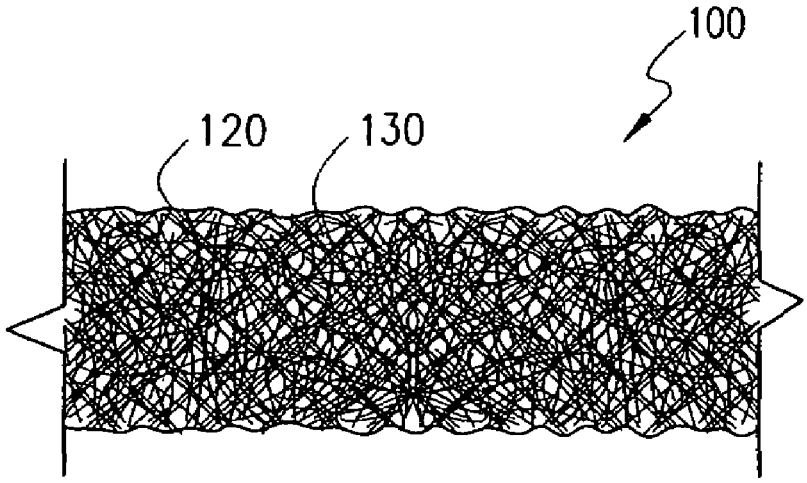
FIG. 1 is a top plan view of a section of an erosion control log constructed in accordance with the aspects of the present invention.
Figure 2:
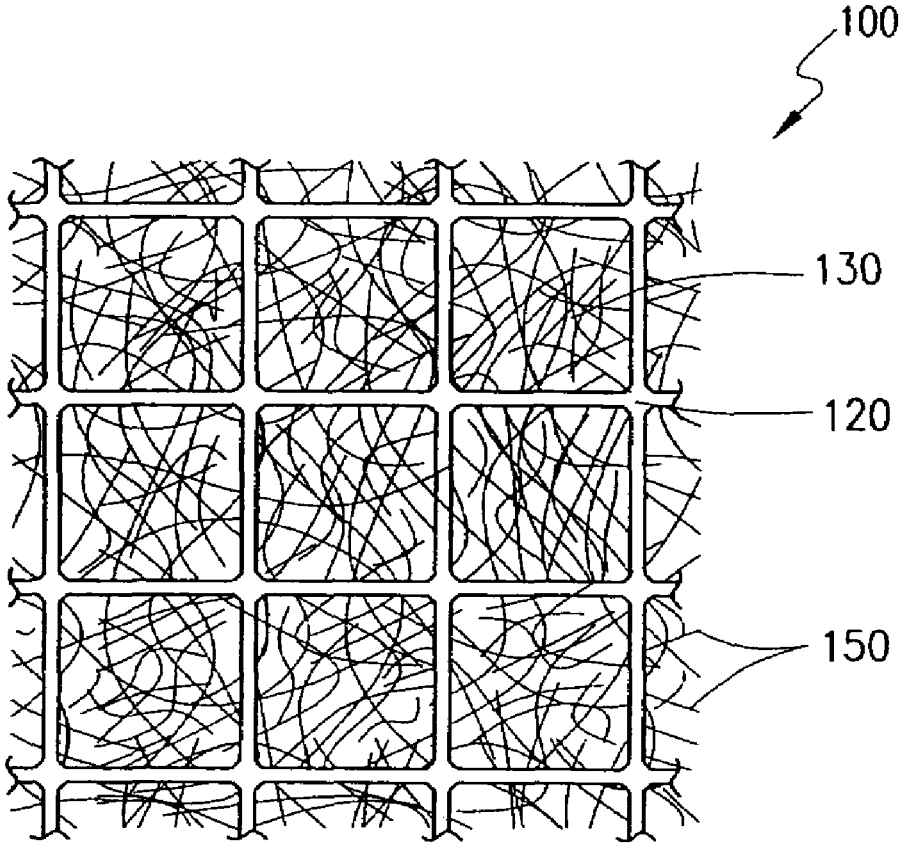
FIG. 2 is an enlarged, fragmentary, cut-away side view of a section of an erosion control log of FIG. 1.
Figure 3:
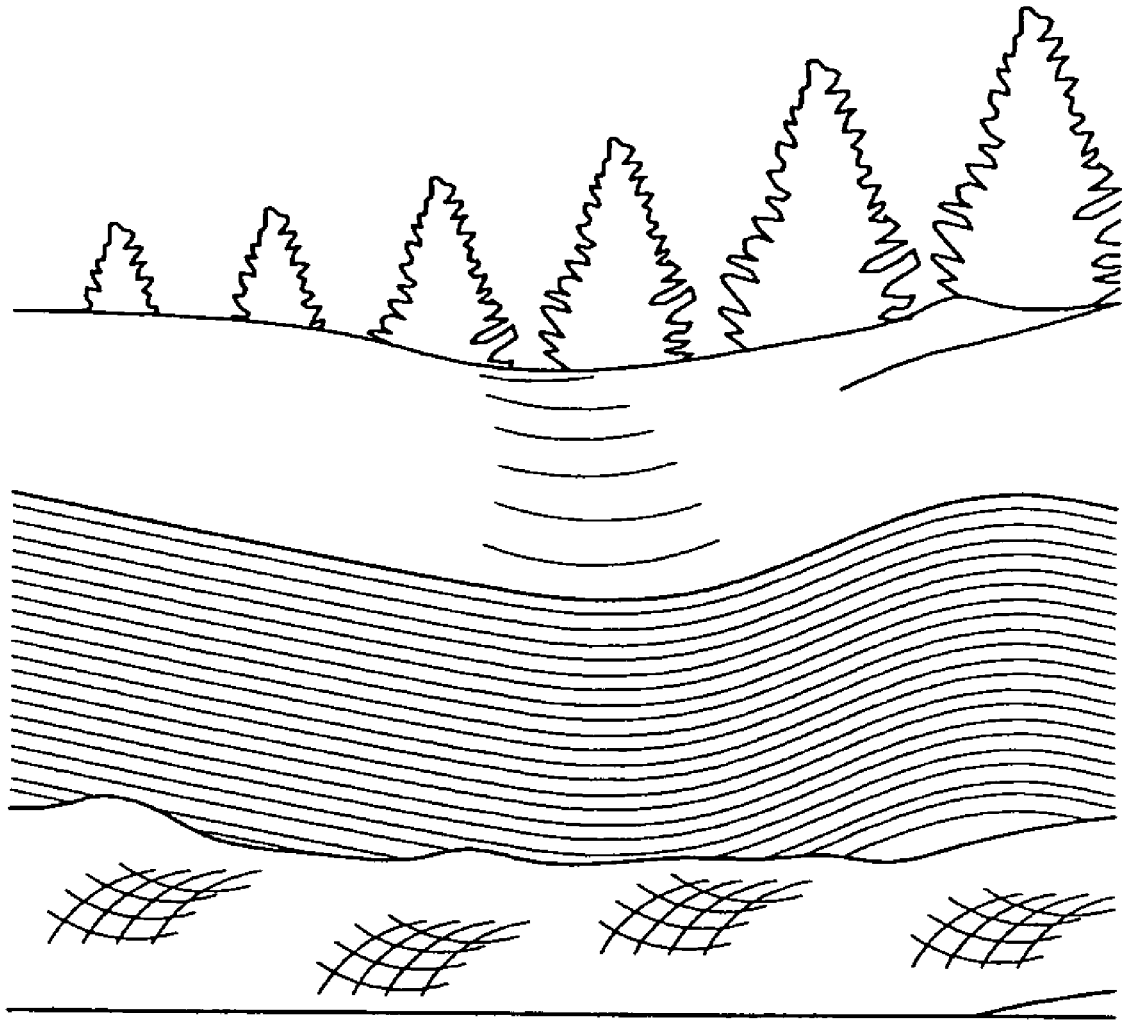
FIG. 3 is a perspective view of an erosion control log of FIG. 1 positioned in an area of water drainage.

Referring now to FIGS. 1-3, a section of an erosion control log 100 of the type used in accordance with the principles of the present invention is set forth and described. Note that each of the drawings have been numbered with like numbers corresponding to like parts. As best seen in FIG. 2, the erosion control log 100 is formed of a sleeve 120, which in the present embodiment is cylindrical, of an open-meshed material of natural or synthetic fibers and filled with a loose fiber filler 130 which is arranged to form a three-dimensional matrix and provides the erosion control log with a required amount of loft or resiliency. Other shapes are contemplated as set forth below.

Referring now to FIGS. 1 and 2, the sleeve 120 is seen to have a open-meshed material or netting with a high percentage of open area. In one embodiment of the present invention, the openings formed by the netting material of sleeve 120 are rectangular in shape with sides ranging from about 0.50 inches to about 1.00 inches in length. The netting itself may be formed of either natural or synthetic materials, and in one preferred embodiment, is of polyethylene (PE), polypropylene (PP), or other suitable polyolefin. It is particularly desirable to make the sleeve 120 or netting of a synthetic material which is both lightweight, strong, and durable enough to resist tearing or rupture of the soil erosion control log 100. The netting material may also include various additives, as known in the art, to improve resistance to ultraviolet (UV) radiation or to impart a particular color. By way of example only, a small amount of carbon black additive, about 0.1% to about 2.5% by weight, may be incorporated into a suitable polymer to impart both a black color and a significant amount of UV resistance into the netting material.

Still referring to FIGS. 1-3, in another embodiment of the present invention, the sleeve 120 may be constructed of select polymer materials, having slightly particular mechanical properties for specific environments. For example, FIG. 3 shows erosion control logs positioned to retain sedimentation in an area of water drainage on a river bank where there may be intense sunlight and prolonged UV radiation. In such a situation, as a way of explanation and not limitation, the sleeve 120 may be formed of 600 denier, high-tensile, polypropylene material having a weight of about 10.0 pounds/1000 square feet and a strand count of about 9.0 and about 13.0 strands/10 inches in the machine and transverse directions, respectively. The netting has rectangular openings with sides of about 0.75 inches to about 1.00 inches in length. The surface of the sleeve 120 would then have a break load of about 57.0 pounds/3 inches in the machine direction and about 73.0 pounds/3 inches in the transverse direction.

The filler material 130 of the erosion control log 100 described above comprises, in one embodiment of the system of the present invention, excelsior, also known as wood wool. The excelsior is typically found in a complex arrangement of bent, twisted and crimped fibers creating a three-dimensional matrix having a desired amount of loft and resiliency. Although the excelsior fibers 150 may be arranged in various ways, due to their twisted and bent configuration, a randomly dispersed loose excelsior fiber will generally produce a log with sufficient loft. It is this loft that comprises one aspect of the present invention, as a method of and system for sedimentation retaining barrier packing is provided. As shown herein, the logs 100 are handled in a way so as to minimize the distortion and/or damage to the log while allowing the logs to be stacked one on top of the other in a nesting relationship for shipment.

Figure 4:
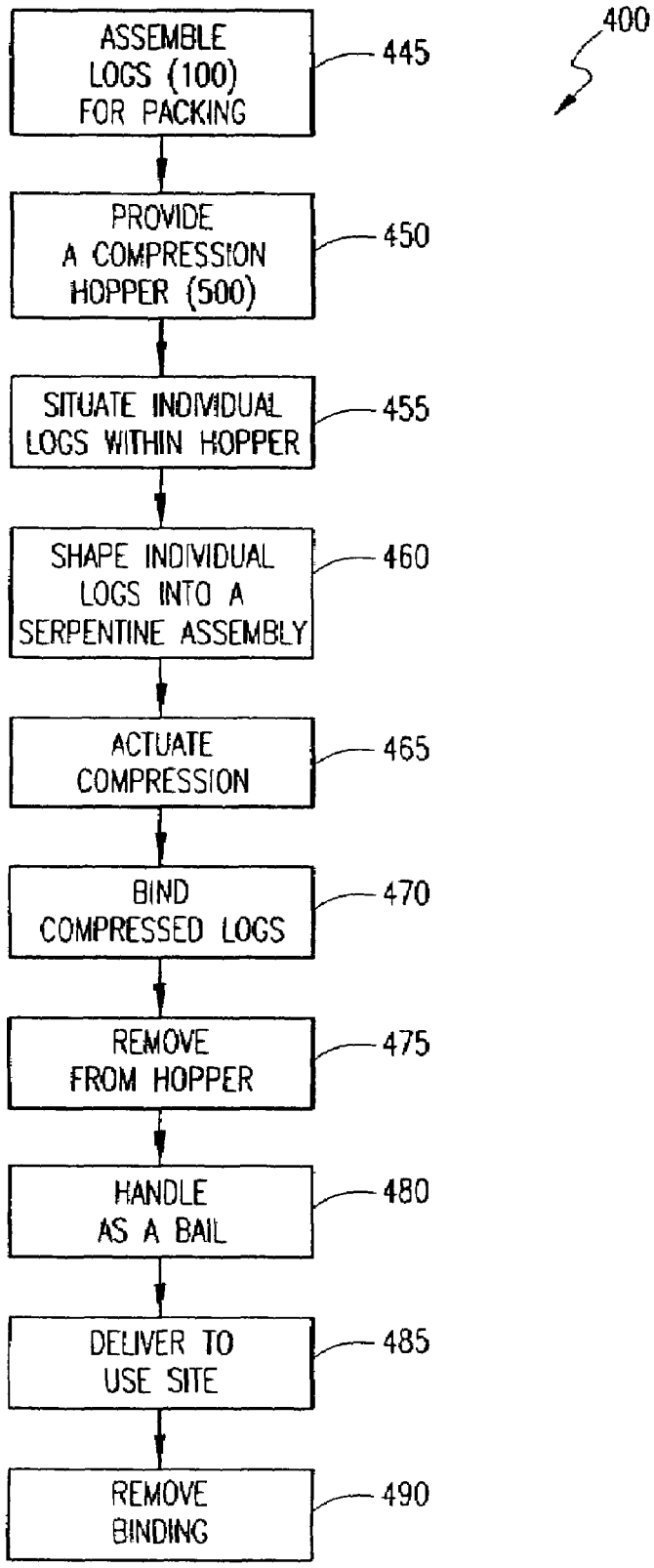
FIG. 4 is a block diagram of steps which are carried out for packing and handling an erosion control log in accordance with the present invention.
Figure 5:
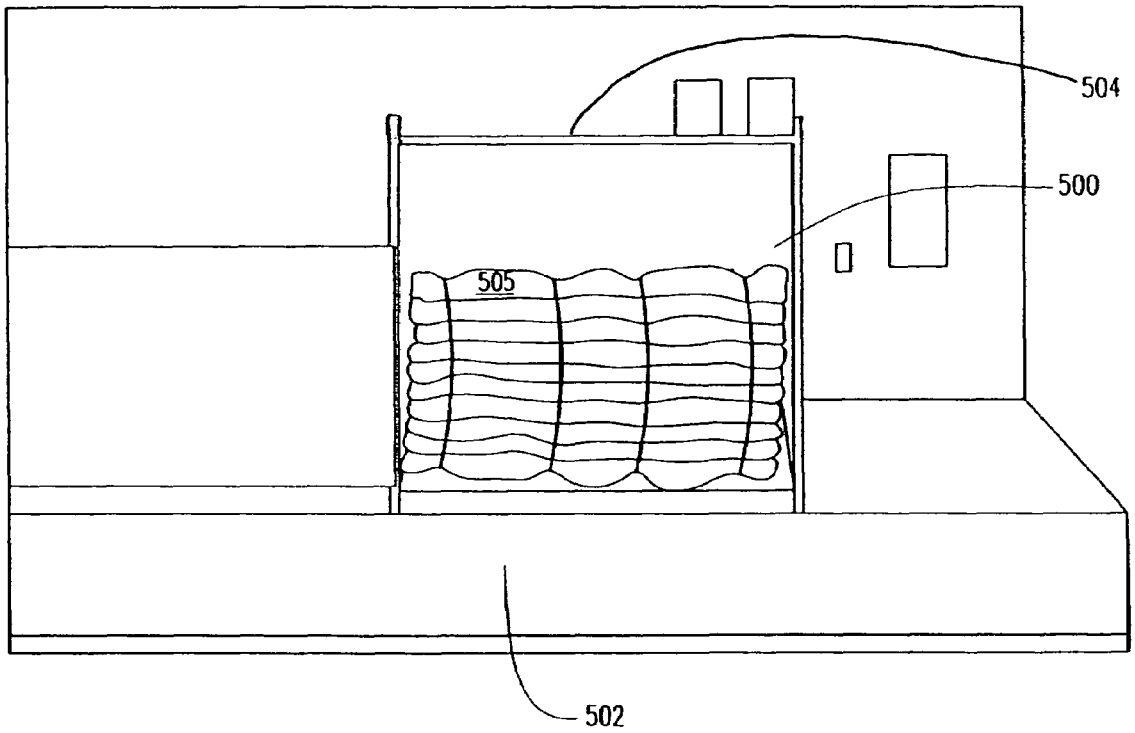
FIG. 5 is a front elevational view of one step of packing an erosion control log of FIG. 1 in accordance with FIG. 4.

Referring now to FIGS. 4 and 5, a block diagram illustrates, by way of example only, the various steps of one embodiment of a packing process 400 which may be followed to minimize permanent deformation of the logs 100 while preparing them for shipment in accordance with the present invention. In one embodiment, a compression hopper 500 is provided with an open frontal region 502 allowing the logs 100 to be inserted therein. A compression or baling plate 504 is positioned thereabove and adapted for compressing the properly aligned logs 100 for subsequent securement.

Figure 5A:
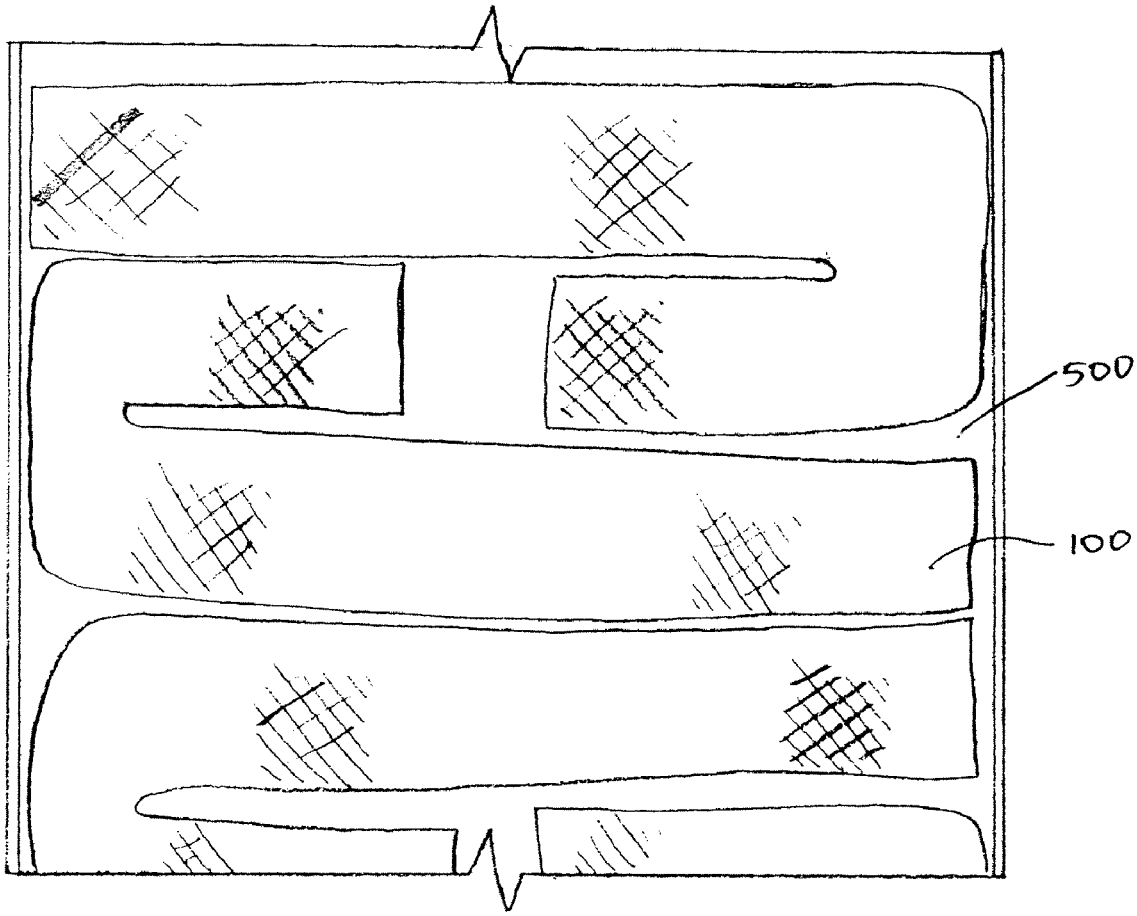
FIG. 5A is an enlarged diagrammatic schematic showing a section of a hopper containing erosion control logs bent into U or J shaped configurations and aligned in a serpentine fashion.

Referring specifically now to FIG. 4, the packing process 400 comprises the following steps: assembling logs 100 for purposes of packing the shipment in step 445; providing a compression hopper 500 in step 450; situating individual logs 100 within the hopper 500 in step 455; bending and shaping the logs 100 to conform with pre-aligned bent portions within the hopper 500 (for example bending the logs into generally U shaped and or J shaped configurations) to align the logs 100 one against the other in a serpentine assembled fashion in step 460 (shown in detail in FIG. 5A); actuating the compression plate 504 (FIG. 5) in step 465 to compress the aligned logs 100 into a desired level of compression (for example, compressed to around 60% of the original diameter) suitable for shipping and handling; applying securing bands or tethers about the compressed logs 100 in step 470 to form a packaged assembly ready for handling. Bending and shaping the logs 100 into a generally U shaped or J shaped configuration is necessary because, as shown in detail in FIG. 5A, in a typical embodiment a width of the hopper 500 is less than an unbent length of the logs 100. Assembling up to around four layers for compression may be preferable in some applications, but any number of layers can be compressed (for example, ten layers are shown in FIG. 5).

Referring still to FIGS. 4 and 5, the compressed logs 100 may be bound by metal bands, tethers formed of synthetic material, and/or any other binding materials, such as rope, wire or the like providing appropriate strength without damaging the compressed logs bound therewith. It may be seen that when using a very narrow or sharp element, such as wire, it may be necessary to incorporate a flexible member (such as fabric) between the binding member and the log 100 to prevent tearing and permanent damage to the log. The compressed and bound logs may then be removed in the form of a bale 505 from the hopper 500 in step 475. The bale 505 thus provides the logs in condition for appropriate handling in step 480. This handling of multiple logs as bale 505 provides both reduced shipping space and ease in handling an otherwise cumbersome item that may be prone to bend, twist and/or move in a fashion hindering the ease and efficiency in handling. With the present invention, the handling of the sedimentation barrier logs 100 as bale 505 maximizes handling efficiency while reducing damage to the individual logs until they can be delivered to the use site as set forth in step 485. Once at the use site, the bales 505 again can be carried to specific use site areas where the binding is cut and/or otherwise removed in step 490 to allow the logs to expand and decompress. In this manner, the logs 100 are available for the use as shown in FIG. 3.

Referring now to FIG. 5, there is shown a perspective view of the hopper 500 with the logs 100 secured therein by tethers after the compression operation described above. It may be seen that the logs are assembled into above described bale 505 with each manifesting a minimum number of folds and thus minimizing the potential for permanent deformation prior to delivery and use.

Figure 6:
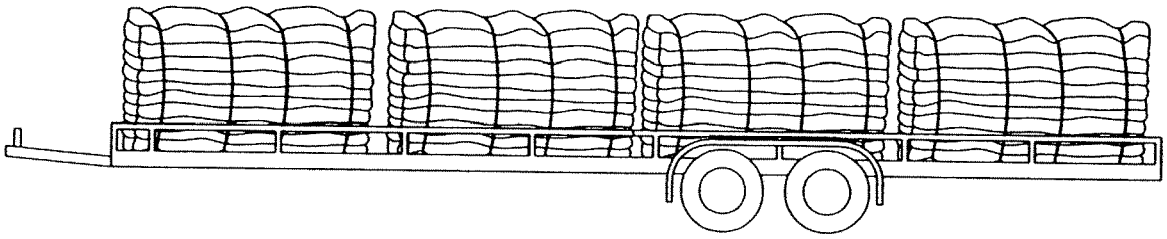
FIG. 6 is a front elevational view of the delivery for handling of the erosion control log of FIG. 1.

FIG. 6 illustrates the compressed and bound erosion control logs being delivered by a trailer for handling. It has been found that sediment control members formed of wood wool as described herein and compressed on the order of 60% of their original diameter will retain decompressibility better than those compressed substantially more, however other levels of compression have been found to be beneficial depending on specific shipping and utilization requirements.

It is thus believed that the operation and construction of the present invention will be apparent from the foregoing description of the preferred embodiments. While the erosion control log, configurations and designs as shown are described as being preferred, it will be obvious a person of ordinary skill in the art that various changes and modifications may be made therein without departing from the spirit and scope of the invention, as defined in the following claims. Therefore, the spirit and the scope of the appended claims should not be limited to the description of the preferred embodiments contained herein.

The invention claimed is:

1. A method of packing elongate sediment control members of the type forming an elongate body of randomly dispersed, loose fill fibers having a select loft for retaining sedimentation in fluid passing there-through when disposed for erosion control, the loose fill fibers being packaged in open mesh material to form the sediment control members of a defined length, the method comprising:

receiving the sediment control members within a compression hopper, wherein the compression hopper comprises a frontal opening providing access to a substantially flat compression plate at an upper end and a substantially flat bottom region for receipt of the open mesh sediment control members therein and compression thereof;

shaping the sediment control members into a serpentine end to end configuration by shaping each of the sediment control members into a serpentine assembly, wherein the compression hopper comprises a width less than a length of the open mesh sediment control members;

compressing the shaped sediment control members by actuating the substantially flat compression plate to move downwardly and apply a force on the shaped sediment control members; and binding, via a plurality of tethers, the compressed sediment control members within the compression hopper for subsequent handling in a compressed state.

2. The method as set forth in claim 1, wherein the loose fill fibers comprise wood wool.

3. The method as set forth in claim 2, wherein the wood wool is provided in the form of excelsior loose fill that is bent, crimped and twisted.

4. The method as set forth in claim 1, wherein the mesh material is provided in the form of a generally cylindrical net sleeve.

5. The method as set forth in claim 4, wherein the net sleeve includes generally rectangular net openings.

6. The method as set forth in claim 4, wherein the net sleeve is formed from synthetic fibers.

7. The method as set forth in claim 6, wherein the synthetic fibers comprise at least one of polyethylene, polypropylene, and other polyolefin.

8. The method as set forth in claim 1, wherein the serpentine end to end configuration of the open mesh sediment control members comprises a U shape within the compression hopper.

9. The method as set forth in claim 1, wherein the serpentine end to end configuration of the open mesh sediment control members comprises a generally J shape configuration.

10. The method as set forth in claim 1, wherein the plurality of tethers comprises a band having opposite ends adapted to be secured around the shaped and compressed open mesh sediment control members.

11. The method as set forth in claim 10, wherein the band is metal.

12. The method as set forth in claim 10 wherein the band is synthetic.

13. The method as set forth in claim 1, wherein the compression hopper is operable to compress the elongate open mesh sediment control members in the compression hopper to approximately 60% of the original diameter thereof.

* * * * *